US005113830A

United States Patent [19]

Haines

[11] Patent Number: 5,113,830

[45] Date of Patent: May 19, 1992

[54] CONTROL SYSTEM FOR ENGINE

[75] Inventor: Steven N. M. Haines, London, England

[73] Assignee: Lucas Industries public limited company, England

[21] Appl. No.: 731,962

[22] Filed: Jul. 18, 1991

[30] Foreign Application Priority Data

Jul. 20, 1990 [GB] United Kingdom ..... 9015922

[51] Int. Cl.[5] ..... F02D 41/04; F02M 39/00

[52] U.S. Cl. ..... 123/436; 123/198.08; 123/506; 73/116

[58] Field of Search ..... 123/436, 481, 506, 332, 123/333, 198.08; 73/116, 117.3; 364/431.08

[56] References Cited

U.S. PATENT DOCUMENTS 4,450,817 5/1984 Ibuki et al. ..... 123/436 X
4,479,476 10/1984 Suzuki et al. ..... 123/436 X
4,577,597 3/1986 Tomita ..... 123/332 X
4,617,892 10/1986 Staerzl ..... 123/436 X
4,625,546 12/1986 Sugo et al. ..... 73/116
4,951,773 8/1990 Poirier et al. ..... 123/481 X
5,042,444 8/1991 Hayes et al. ..... 123/481 X

*Primary Examiner*—Willis R. Wolfe
*Attorney, Agent, or Firm*—Jenner & Block

[57] ABSTRACT

A control system for the fuel system of an engine which has electrically operated valves which control the quantity of fuel supplied to the combustion chambers of an engine includes a disablement controller which in a test situation can operate to prevent the supply of fuel to the combustion chambers in turn. The system also includes a comparator which observes the variation of an engine operating parameter e.g. fuel level during the test and trim circuit which acts to modify the amount of fuel supplied to the individual combustion chambers on the basis of signals provided by the comparator, so that each combustion chamber contributes substantially equally to the power output of the engine.

6 Claims, 1 Drawing Sheet

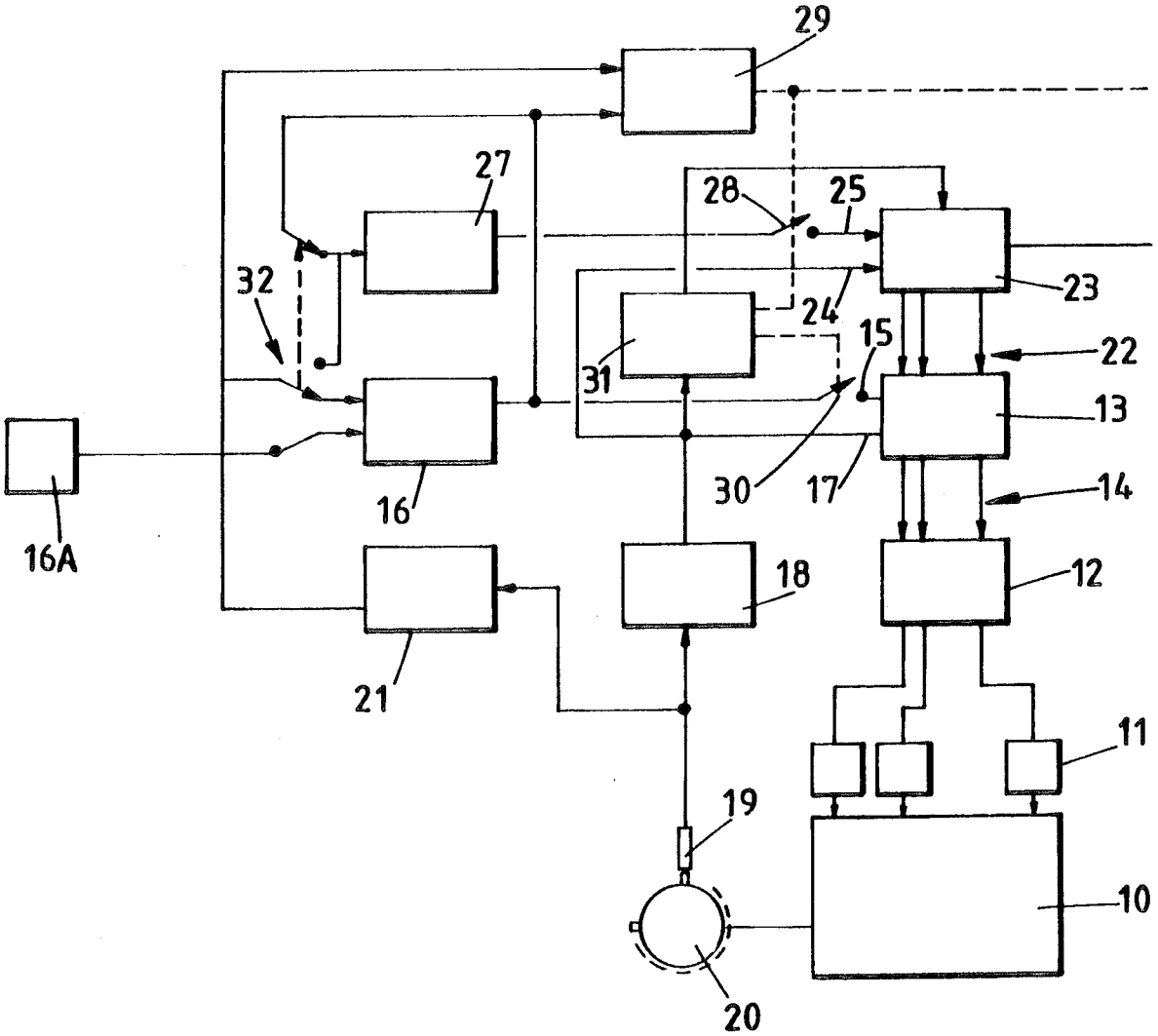
10
11
12
13
14
15
16
16A
17
18
19
20
21
22
23
24
25
27
28
29
30
31
32

CONTROL SYSTEM FOR ENGINE

BACKGROUND OF THE INVENTION

This invention relates to a method of operating and to a control system for the fuel system of a compression ignition engine the fuel system including control means operable by the control system to determine the amount of fuel supplied to the combustion chambers of an associated engine.

In a known fuel system individual engine actuated fuel pumps supply fuel to respective engine cylinders and each fuel pump includes a control valve operable to determine the amount of fuel supplied to the respective engine cylinder. In another known fuel system a single pump is provided and the fuel delivered by the pump is supplied to the engine cylinders in turn by means of a fuel distributor. A single control valve is utilized to determine the amount of fuel supplied to the engine cylinders.

During the operation of an engine there is a natural fluctuation in the speed of the engine as each cylinder partakes of its power stroke. If the engine is in good condition and each cylinder is receiving the same amount of fuel the fluctuations in the speed should be equal. If however one cylinder receives more or less fuel than the remaining cylinders due to some defect in the fuel system or if one cylinder is defective because of leakage past the valves or piston rings then the fluctuation of speed will not be the same.

The equalization of fuel flow can be effected by modifying the operation of the control valve for the particular pump associated with the cylinder which is receiving more or less fuel, or by modifying the operation of the single control valve during the time when it is dealing with the supply of fuel to the cylinder which is receiving more or less fuel. Supplying more fuel to a defective cylinder may reduce the fluctuation of speed but it is desirable that some sort of warning should be given when the degree or rate of modification to the operation of the control valve exceeds a predetermined amount.

With a four cylinder engine it is possible to measure during operation of the engine, the engine speed during each power stroke and to compare this speed with the average speed or to compare it with the speed measured during the previous power stroke. In this way it is possible to identify which cylinder is at fault, GB No. 2112180 and GB No. 2196153 described systems of the aforesaid type.

When the engine has an increased number of cylinders the natural fluctuation of engine speed is reduced and whilst in theory it should be possible to use the techniques advanced in the aforesaid specifications to identify the defective cylinder, in practice, it is difficult to achieve a satisfactory result.

SUMMARY OF THE INVENTION

The object of the invention is to provide a method of operating and a control system for the fuel system of a compression ignition engine in a simple and convenient form.

According to the invention a method of operating a control system of the kind specified comprises causing said control means to halt for a predetermined number of engine operating cycles the delivery of fuel to the engine combustion chambers in turn, measuring the variation of an engine operating parameter which occurs whilst each combustion chamber is inoperative and comparing the values of variation obtained to provide an indication of the function of the individual engine combustion chambers.

BRIEF DESCRIPTION OF THE DRAWING

An example of a control system in accordance with the invention will now be described with reference to the accompanying block diagram which also shows the engine and part of the fuel system.

DETAILED DESCRIPTION OF THE INVENTION

With reference to the diagram a multi-cylinder compression ignition engine is shown at 10 and is provided with pump injectors 11 equal in number to the number of engine cylinders. Each pump injector incorporates a control means in the form of an electromagnetically operable spill control valve. The pump injectors are actuated by cams driven by the engine each pump injector incorporating a pumping plunger which when driven inwardly by its respective cam delivers fuel through the respective injection nozzle providing the associated spill control valve is closed.

The solenoids of the spill control valves are supplied with current from actuator drive circuits shown at 12.

In order to initiate operation of the spill valve at the correct time, a so called distributor circuit 13 is provided which has control outputs 14 connected to the individual power circuits 12 and a first input 15 which is connected to a so-called fuel circuit 16. A second input 17 of the distributor circuit 13 receives a cylinder identification signal from a cylinder identification circuit 18. The cylinder identification circuit 18 is supplied with pulse signals by a transducer 19 which is responsive to marks or other indicia on a wheel 20 which is driven at ½ engine speed in the case of a four stroke engine and at engine speed in the case of a two stroke engine.

The output signal of the transducer 19 is also supplied to a speed calculation circuit 21 and which provides a signal indicative of the average speed of the engine. The average speed signal together with a speed demand signal are supplied to the fuel control circuit 16 and the output of the fuel control circuit is a signal representative of the desired period in terms of engine degrees of rotation during which the spill valves should be closed. The demand signal is supplied by a transducer 16A associated with an operator adjustable control.

In operation the fuel control circuit 16 determines the period in terms of engine degrees of rotation during which the spill valves of the pump injectors are to be closed and hence the quantity of fuel to be delivered to the engine. The distributor circuit 13 ensures that the spill valves are closed in turn and during the inward movement of the respective plungers. The fuel control circuit 16 also acts as a speed governor to control the idling speed of the engine when the demand from the operator is zero, and also the maximum speed of the engine. It may also take into account other engine operating parameters such as coolant temperature and inlet manifold air pressure.

Assuming that the pump injectors are functioning correctly and that the engine is in good order, each engine cylinder will receive the same amount of fuel and each engine cylinder will produce the same power. The fluctuations of engine speed which take place as a result of the power strokes of the individual engine cylinders will be the same. In practice it is unlikely that exactly the same amount of fuel will be supplied to each engine cylinder due to normal production variations encountered during the manufacture of the various parts. Moreover, in large marine or locomotive engines the individual engine cylinders again due to manufacturing tolerances may have slightly different cubic capacities. In order to take into account the differing fuel quantities which will result in unequal power outputs from the cylinders the distributor circuit 13 has correction inputs 22 which are connected to a trim circuit 23. The trim circuit has an input 24 which receives a signal directly from the identification circuit 18 and a further input 25 to which input difference signals are supplied which are generated by a comparator 27. In the case where the system is operating in the "all speed" or "closed loop" governing mode as illustrated, the comparator 27 is supplied with the signal provided by the fuel control circuit 16. In this case the demand signal provided by the transducer 16A is a speed demand signal. The application of the signals generated by the comparator 27 is only required when a test is being carried out and therefore a switch 28 represented by a relay contact is provided between the input 25 and the comparator. The switch 28 is actuated by a balancing test control circuit 29 which has inputs connected to the speed calculation circuit 21 and the fuel control circuit 16 respectively.

In operation when the test control circuit 29 closes the switch 28 to initiate a test it also renders operative a disablement controller circuit 31 which receives a signal from the cylinder identification circuit 18.

The circuit 31 provides a signal to the trim circuit 23 to identify the pump injector 11 which is to be disabled and also provides a control signal to a further switch 30 which is normally closed but which is opened at the appropriate instant to prevent operation of the selected pump injector 11. One cylinder of the engine therefore receives no fuel.

The practical effect is that the fuel control circuit 16 will respond to the slight drop in engine speed and will extend the pumping period of the remaining pump injectors so that the remaining engine cylinders receive slightly more fuel and so develop more power to substantially restore the engine speed to its original value. After an initial period to allow the fuel control circuit to respond, each pump injector is disabled in turn the period of disablement for each pump injector lasting for as long as it takes for the system to reach a steady condition for example about ten engine cycles or twenty engine revolutions.

From the signals provided by the comparator 27 the trim circuit 23 is able to determine the contribution made by each engine cylinder and to adjust the fuel supplied to the individual cylinders so that the contribution of each cylinder in terms of power output is substantially the same.

At the completion of the test the test control circuit 29 opens the switch 28. Moreover, the disablement controller circuit 31 no longer opens the switch 30 so that all the pump injectors supply fuel to their respective cylinders using the correction factors stored in the trim circuit. The test control circuit 29 can be arranged to repeat the test at regular intervals or it can be arranged to repeat the test when the average speed signal or the signal provided by the fuel control circuit or both, reach a predetermined operating point and/or there has been little variation around the operating point for a predetermined time. The initiation of a test can also be effected if so desired by the engine operator. Moreover, in situations where the load on the engine is fluctuating, if a test has been initiated it will have to be aborted.

In the case when the system is operating in the "two speed governing" mode and the speed range lies in the intermediate range i.e. above engine idling speed and below maximum speed, the length of the fuel angle signal provided by the fuel control circuit 16 is determined by the engine operator assuming that no engine operating parameters are exceeded. The fuel control circuit 16 will still receive the average speed signal but only for use if the engine speed approaches the allowed maximum speed or the idling speed. The comparator 27 will now receive the average speed signal instead of the output signal from the fuel control circuit 16, since in this case when one pump injector 11 is disabled the engine speed will fall and the extent by which the speed falls depends upon the contribution of the particular engine cylinder. The diagram shows a selector switch 32 for selecting the "all speed" or "two speed" governing mode.

The arrangement as described can correct for differences in the operating characteristics of the pump injectors and the individual engine cylinders. It is desirable to set a limit to the extent of correction or rate of change of correction which can be effected and to provide a warning and in some instances disable the particular pump injector since excessive correction may indicate a fault such for example as a leaking engine valve. Instead of disabling the pump injector it can be arranged that the extent of correction reverts to a default value so that although the desired balance of fuel delivery is not achieved the cylinder which receives fuel from the defective injector will continue to receive some fuel and will therefore contribute to the power output of the engine.

I claim:

1. A method of operating a control system for the fuel system of a compression ignition engine the fuel system including control means operable by the control system to determine the amount of fuel supplied to the combustion spaces of the engine the method being comprised of causing the control means to halt for a predetermined number of engine cycles the delivery of fuel to the engine combustion chambers in turn, measuring the variation of an engine operating parameter which occurs whilst each combustion chamber is inoperative and comparing the values of variation obtained to provide an indication of the function of the individual engine combustion chambers.

2. A method according to claim 1, in which the values of variation obtained are utilized to adjust the amount of fuel supplied to respective engine cylinders.

3. A method according to claim 2, in which said operating parameter is the engine speed.

4. A method according to claim 2, in which said operating parameter is a signal indicative of the amount of fuel to be supplied to the remaining combustion chambers of the engine whilst each combustion chamber is inoperative.

5. A control for the fuel system including a compression ignition engine, the fuel system including a control means operable to determine the amount of fuel supplied to the engine, and the control system including drive circuits for the control means, a distributor circuit operable to initiate the operation of the drive circuits in turn in accordance with the output of a combustion chamber identification circuit, a fuel control circuit operable to provide to said distributor circuit a signal indicative of the amount of fuel to be supplied to each combustion chamber, a disablement controller operable to prevent the supply of fuel to the combustion chambers of the engine in turn and for a predetermined number of engine operating cycles, and a comparator operable to measure the variation of an engine operating parameter which occurs whilst each combustion chamber is inoperative.

6. A control system according to claim 5, including a trim circuit which receives the output from the comparator and modifies the operation of the distributor circuit so that the quantities of fuel supplied to the individual combustion chambers result in substantially equal power outputs from the individual engine cylinders.

* * * * *

UNITED STATES PATENT AND TRADEMARK OFFICE

CERTIFICATE OF CORRECTION

PATENT NO. : 5,113,830

DATED : May 19, 1992

INVENTOR(S) : Steven N. M. Haines

It is certified that error appears in the above-identified patent and that said Letters Patent is hereby corrected as shown below:

Column 4, line 63, delete "including" and insert therefor --of--.

Signed and Sealed this

Third Day of August, 1993

Michael K. Kirk

*Attest:*

MICHAEL K. KIRK

*Attesting Officer*

*Acting Commissioner of Patents and Trademarks*